US008328628B2

(12) United States Patent
Kim

(10) Patent No.: US 8,328,628 B2
(45) Date of Patent: Dec. 11, 2012

(54) GAMING SYSTEM AND A METHOD OF GAMING

(75) Inventor: Hyong Joo Kim, Meadowbank (AU)

(73) Assignee: Aristocrat Technologies Australia Pty Limited, North Ryde, NSW (AU)

( * ) Notice: Subject to any disclaimer, the term of this patent is extended or adjusted under 35 U.S.C. 154(b) by 1023 days.

(21) Appl. No.: 12/239,370

(22) Filed: Sep. 26, 2008

(65) Prior Publication Data

US 2009/0137316 A1 May 28, 2009

(30) Foreign Application Priority Data

Sep. 27, 2007 (AU) ..... 2007905316

(51) Int. Cl.
*A63F 9/24* (2006.01)

(52) U.S. Cl. ..... 463/25

(58) Field of Classification Search ..... 463/25
See application file for complete search history.

(56) References Cited

U.S. PATENT DOCUMENTS

| | | | | |
|---|---|---|---|---|
| 6,068,552 | A * | 5/2000 | Walker et al. | 463/21 |
| 2004/0038724 | A1 | 2/2004 | Asdale | |
| 2004/0242302 | A1 | 12/2004 | Baerlocher | |
| 2007/0111791 | A1 * | 5/2007 | Arbogast et al. | 463/40 |
| 2007/0173316 | A1 | 7/2007 | Cowan et al. | |

FOREIGN PATENT DOCUMENTS

| | | |
|---|---|---|
| CA | 2519386 | 12/2003 |
| CA | 2552810 | 11/2005 |
| GB | 2211338 | 6/1989 |
| JP | 10146418 | 6/1998 |
| WO | 2005107913 A1 | 11/2005 |
| WO | 2006017067 | 2/2006 |

* cited by examiner

*Primary Examiner* — Omkar Deodhar
(74) *Attorney, Agent, or Firm* — Hanley, Flight & Zimmerman, LLC

(57) ABSTRACT

A gaming controller arranged to conduct a game having an overall return to player (RTP) and including a base game and a feature game. The gaming controller is arranged to conduct a base game and a feature game and includes an RTP controller arranged to operate in response to a player RTP instruction to configure a relative contribution of the base game and the feature game to the overall RTP.

21 Claims, 7 Drawing Sheets

GAMING SYSTEM AND A METHOD OF GAMING

CROSS-REFERENCE TO RELATED APPLICATIONS

The present application claims the benefit of priority to Australian Provisional Patent Application No. 2007905316, filed on Sep. 27, 2007, entitled "A GAMING SYSTEM AND A METHOD OF GAMING", which is herein incorporated by reference in its entirety.

FIELD OF THE INVENTION

The present invention relates to a gaming system, a method of gaming, a game controller and computer program code.

BACKGROUND OF THE INVENTION

It is known to provide a gaming system which includes a game controller arranged to conduct a game that includes a base game and a feature game which is triggered from the base game, for example if a symbol combination occurs.

While such gaming systems provide users with enjoyment, a need exists for alternative gaming systems in order to maintain or increase player enjoyment.

SUMMARY OF THE INVENTION

In accordance with a first aspect of the present invention, there is provided a gaming network including:

In a first aspect, the invention provides a game controller arranged to conduct a game having an overall return to player (RTP) and including a base game and a feature game, the game controller arranged to conduct a base game and a feature game, and including an RTP controller arranged to operate in response to a player RTP instruction to configure a relative contribution of the base game and the feature game to the overall RTP.

In an embodiment, the game controller includes: a base game module arranged to conduct a base game having a base RTP; and a feature game module is arranged to conduct a feature game having a feature RTP.

In an embodiment, the RTP controller configures the relative contribution of the base RTP and the feature RTP by specifying base RTP data and feature RTP data to be employed by the base game module and feature game module respectively.

In an embodiment, the RTP of the base game has an allowable range.

In an embodiment, the RTP of the feature game has an allowable range.

In an embodiment, the player RTP instruction includes data specifying a value within a range of allowable relative RTPs of the base game and feature game.

In an embodiment, the game controller is constituted by a processor arranged to execute instructions stored in a memory to implement at least the RTP controller.

In a second aspect, the invention provides a gaming system including:

a player interface including an RTP instruction mechanism operable by a player to input an RTP instruction and;

an RTP controller arranged to configure a relative contribution of the base game and a feature game to the overall RTP of the game in response to the RTP instruction.

In an embodiment, the RTP instruction mechanism is operable to select a plurality of relative RTPs within a range.

In an embodiment, the player interface includes a display and RTP instruction mechanism includes a slider bar displayed on the display and operable by a player to select a position within the range.

In an embodiment, the player interface includes a touch screen operable to select the position of the slider bar.

In an embodiment, the touch screen is operable by a player to drag the slider bar.

In a third aspect, the invention provides a method of gaming including: providing a game having an overall RTP, the game including a base game and a feature game; and configuring a relative contribution of the base game and the feature game to the overall RTP in response to a players instruction.

In an embodiment, the method includes configuring the relative contribution of the base RTP and the feature RTP by specifying base RTP data and feature RTP data to be employed by a base game module and a feature game module respectively.

In an embodiment, the method includes controlling the RTP of the base game to be within an allowable range.

In an embodiment, the method includes controlling the RTP of the base game to be within an allowable range.

In a fourth aspect, the invention provides a player interface for a game including a base game and a feature game, the player interface including an RTP instruction mechanism operable by a player to input a player instruction specifying a relative contribution to an overall RTP of at least one of the base game or the feature game.

In an embodiment, the player interface includes a display and RTP instruction mechanism includes a slider bar displayed on the display and operable by a player to select a position within the range.

In an embodiment, the player interface includes a touch screen operable to select the position of the slider bar.

In an embodiment, the touch screen is operable by a player to drag the slider bar.

In a fifth aspect, the invention provides a computer program code which when executed implements the above method.

In a sixth aspect, the invention provides a computer readable medium including the computer program code.

In a seventh aspect, the invention provides a data signal including the computer program code.

In an eight aspect, the invention extends to transmitting the computer program code.

BRIEF DESCRIPTION OF THE DRAWINGS

Certain embodiments of the present invention will now be described, by way of example only, with reference to the accompanying drawings, in which.

Figure 1:
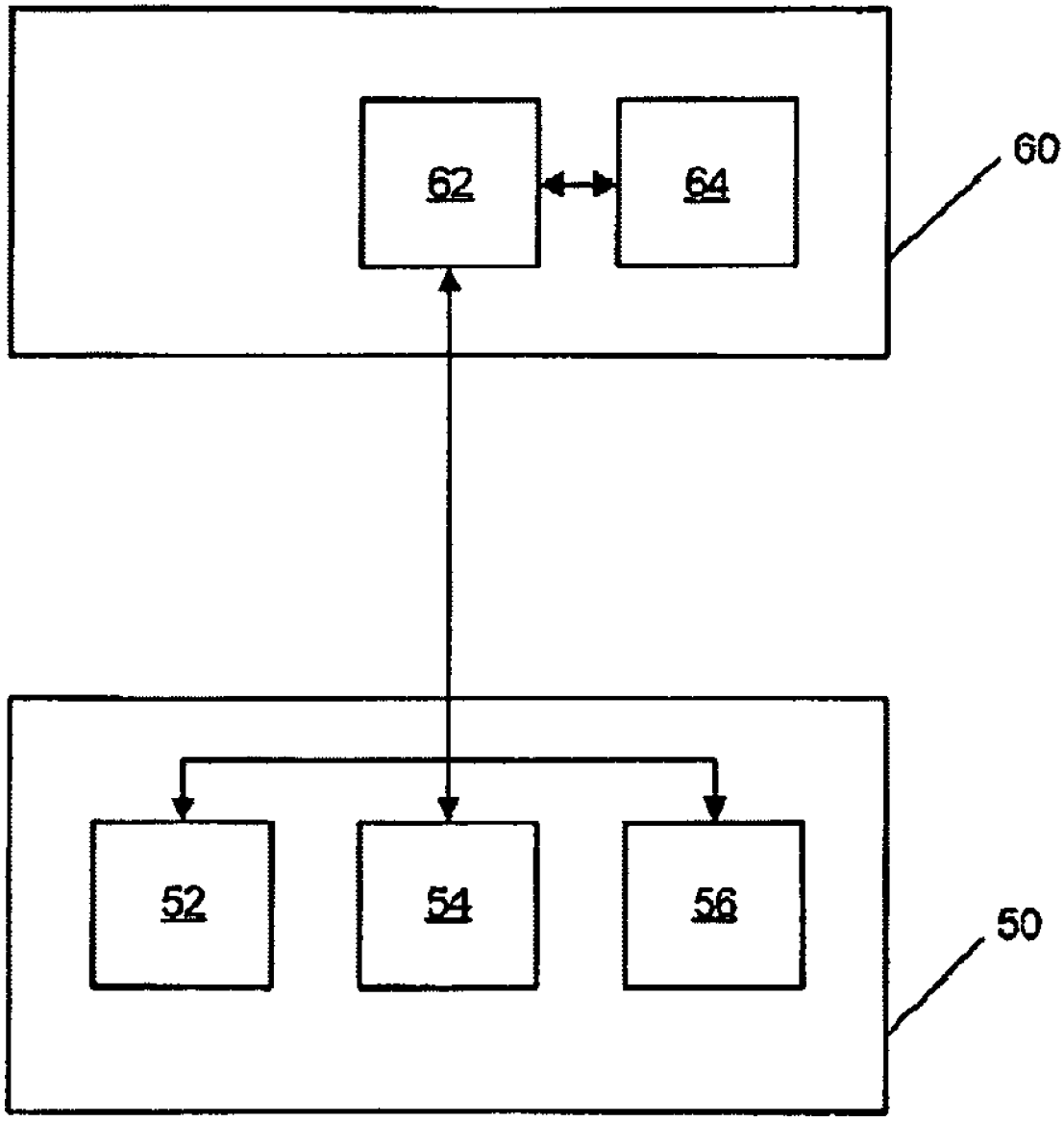
FIG. 1 is a block diagram of the core components of a gaming system.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DESCRIPTION OF CERTAIN EMBODIMENTS

Certain embodiments provide a gaming system where a player plays a game having a base game and a feature game and the player can adjust to relative contribution of the base game and the feature game to the overall return to player (RTF) of the game. The RTF is the percentage of the amount wagered on a gaming machine over the long term which is intended to be returned to the player. The gaming system may be provided in a number of different forms.

In a first form, a stand alone gaming machine is provided wherein all or most components for implementing the game are present in a player operable gaming machine.

In a second form, a distributed architecture is provided wherein some of the components for implementing the game are present in a player operable gaming machine and some of the components for implementing the game are located remotely relative to the gaming machine.

For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components for the player to enter instructions and play the game.

Components of the player interface may vary from embodiment to embodiment but will typically include a credit mechanism 52 to enable a player to input credits and receive payouts, one or more displays 54 and a game play mechanism 56 that enables a player to input game play instructions.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g., a PC) or a server.

Figure 2:
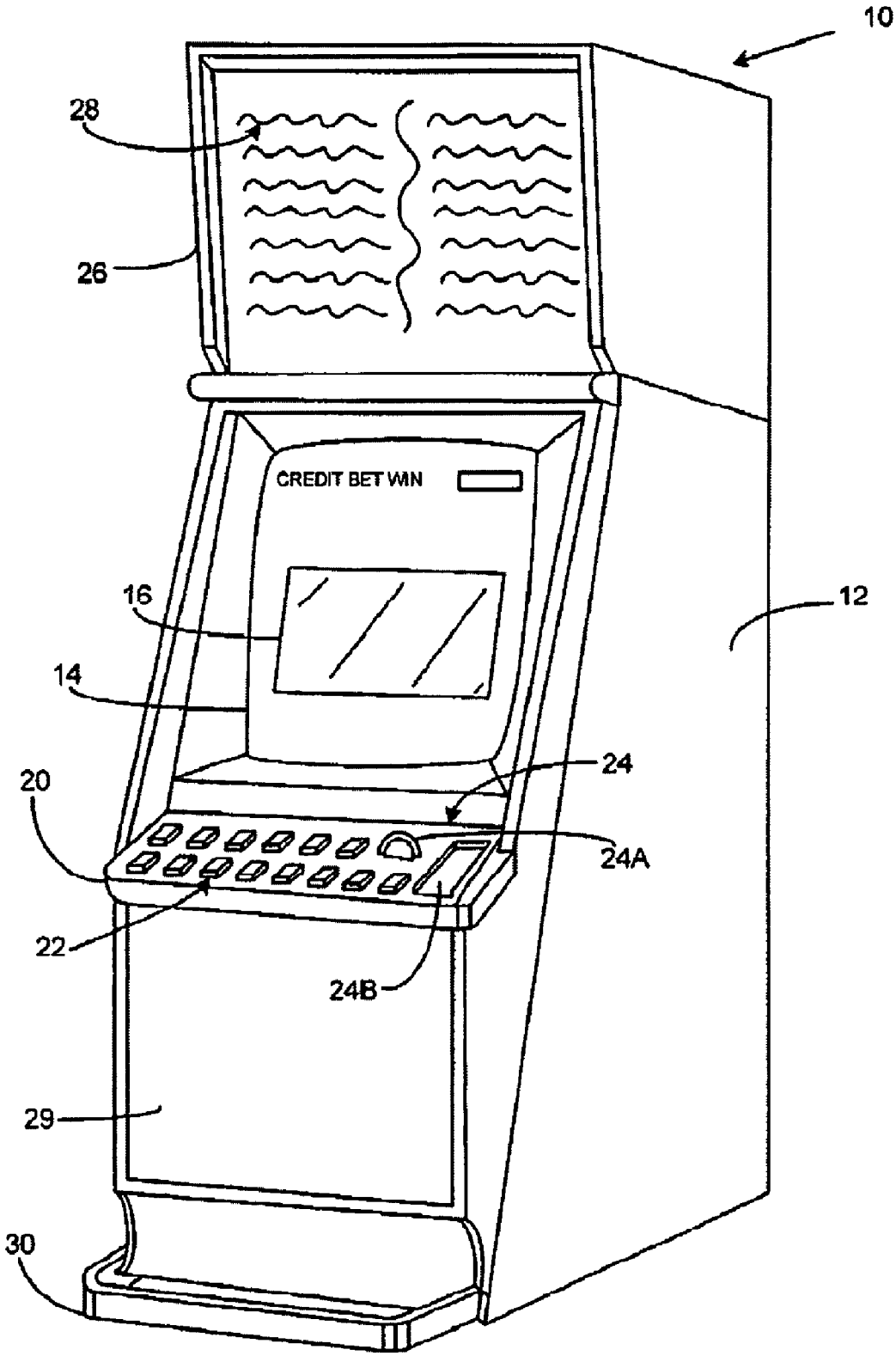
FIG. 2 is a perspective view of a gaming machine.

A gaming system in the form of a stand alone gaming machine 10 is illustrated in FIG. 2. The gaming machine 10 includes a console 12 having a display 14 on which is displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module may be provided having a reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
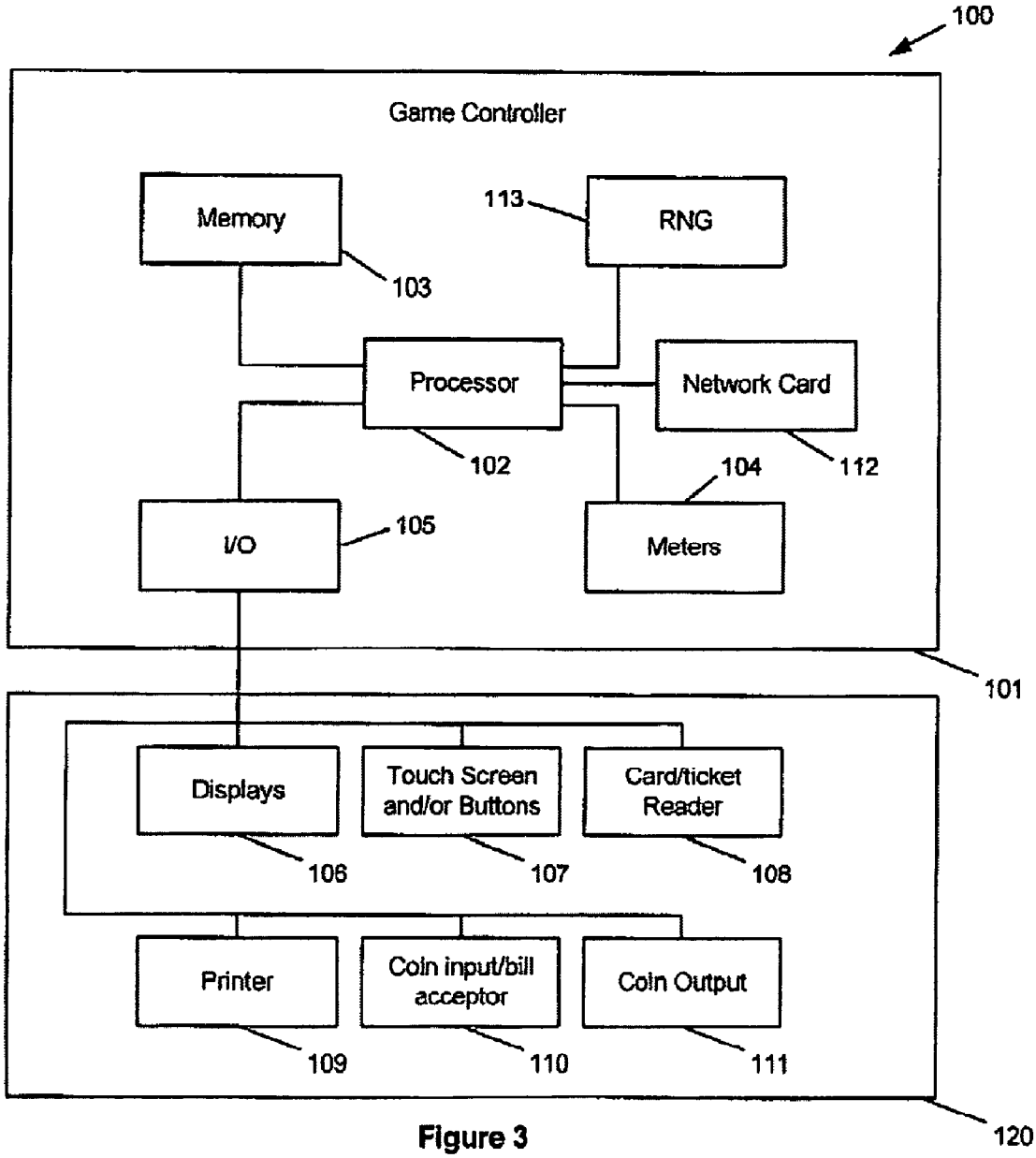
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and buttons 107, a card and/or ticket reader 108, a printer 109, a bill acceptor and/or coin input mechanism 110 and a coin output mechanism 111. Additional hardware may be included as part of the gaming machine 100, or hardware may be omitted for a specific implementation.

In addition, the gaming machine 100 may include a communications interface, for example a network card 112. The network card may, for example, send status information, accounting information or other information to a central controller, server or database and receive data or commands from the central controller, server or database.

Figure 4:
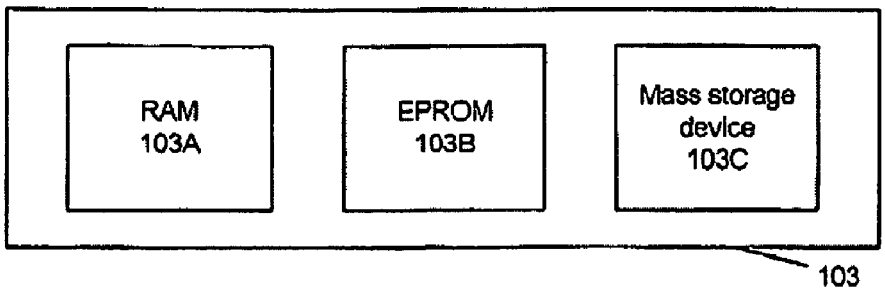
FIG. 4 is a block diagram representing the structure of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
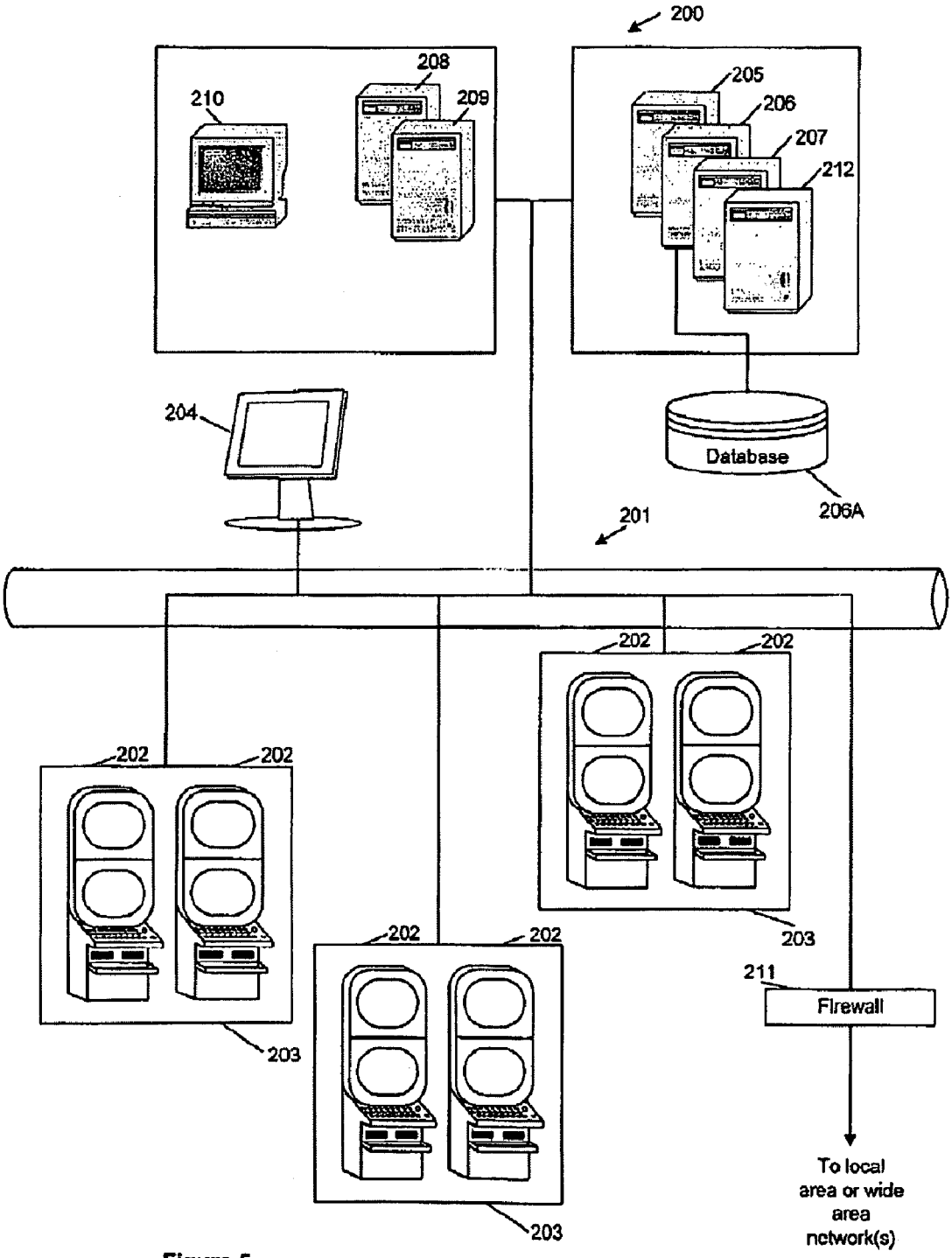
FIG. 5 is a diagram schematic of a networked gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game with this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to carry out the accounting in respect of the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming network 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of games servers could be provided to run different games or a single game server may run a plurality of different games depending upon the terminals.

The embodiment may be implemented in relation to a spinning reel type game. Gaming systems for implementing games that involve a display of spinning reels as part of the display of the outcome of a game have either a video display or a mechanical display, these later machines most usually being "stepper" machines which have a separate motor for each reel. However, persons skilled in the art will appreciate that the invention can be implemented in respect if other forms of games, including: card games; ball draw games (e.g. bingo or keno); dice games; and pin and ball games.

In some implementations the game controllers of such gaming machines select symbols by employing a stop determining function that randomly determines the stop position for each reel. For example, if there are five reels, each having twenty symbols, the stop determining function might determine that the stop positions are positions: 3, 13, 7, 9 and 17. The spinning of the reels is then controlled so that each symbol comes to a stop in the same row, typically a predetermined row in a "window" visible to the player on the display that which corresponds to a player playing a single win line. When a reel stops, the symbols will be in one of a plurality of possible symbol positions for that reel relative to the stop position.

Spinning reel type games typically allow a player to select how many win lines of a plurality of win lines they will play in each game—i.e. a minimum of one win line up to the maximum number of win lines allowed by the game. Persons, skilled in the art, will appreciate that in other embodiments, the player may select a number of reels to play. Each win line is formed by a set of symbol positions consisting of one symbol position from each reel. That is, a predetermined symbol position of each reel is assigned to a win line. The symbol positions that constitute each of the win lines are usually advertised to the player by markings on the display or diagrams showing the symbol positions that correspond to each win line. A game outcome is determined based on the symbols on the win lines and a prize table that specifies awards. Other techniques for establishing a bet such as selecting reels or pay tables to play are also known.

Figure 6:
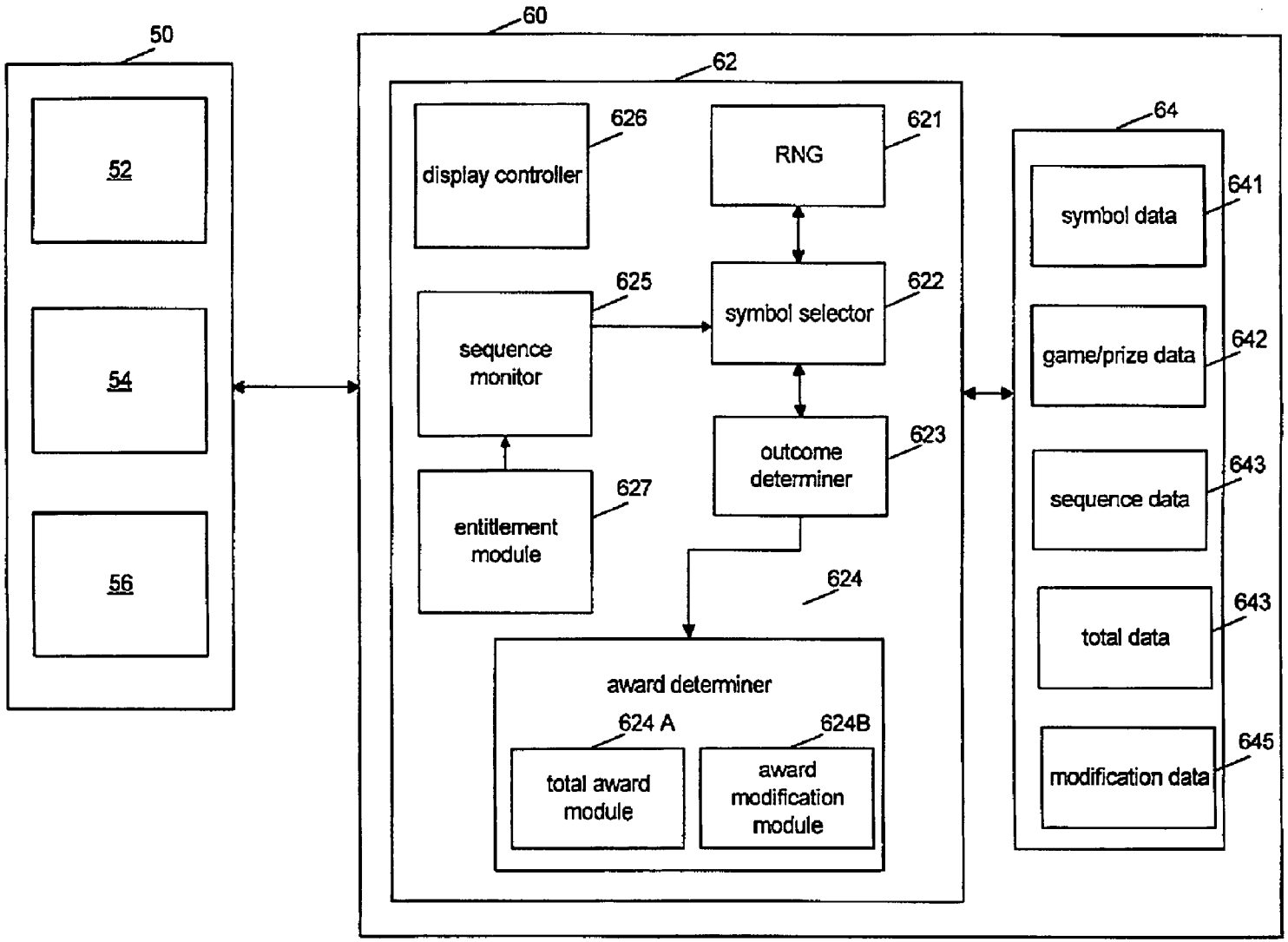
FIG. 6 is a further block diagram of the gaming system.

The game controller 60 of the embodiment is shown in more detail in FIG. 6. It will apparent that the processor 62 implements a number of modules. In the embodiment, the processor 62 of the game controller implements a base game module 621 which implements the base game rules 641 to carry out a base game and a feature game module 623 which implements the feature game rule 642 to carry out a feature game. Typically a trigger condition specified by the base game rules 641 causes the feature game to start. For example, the appearance of a designated combination of symbols on the display.

Other trigger conditions are known to persons skilled in the art for example the placing of a special bet, a triggering event being caused by a system such as a jackpot system, or game turnover.

In the embodiment the processor implements an RTP controller 622 which is operable in response to a RTP instruction entered by the player using an RTP input mechanism 56A of the player interface 50. The RTP controller 622 configures the base game module and the feature game module stick 623 to provide a relative contribution to the overall RTP of the game in accordance with the player instruction mechanism. In this respect, it will be appreciated that the player need not be apprised of the absolute contribution to RTP to configure the relative RTP. A person skilled in the art will appreciate that the RTP of the base game and feature game may be changed in a number of ways. In the illustrated embodiment, it is achieved by employing a set of paired probability tables 641A, 642A; 641B, 642B; and 641C, 642C.

Three pairs of tables are illustrated in FIG. 6. However, as indicated by pair 641C, 642C there may be N pairs of tables where N is a positive integer chosen by the game designer to provide sufficient variety of different relative contributions to the RTP. Each pair of tables provides a different contribution to the overall RTP by the base game from feature game. For example, in the case of three tables, the first table pair 641A, 642A may provide a 30:70 split between the base and feature game, the second table pair 641B, 642B may provide a 50:50 split, and the third table pair 641C, 642C may provide a 70:30 split between the base and feature game.

Accordingly, the RTP controller advises each of the base game modules 621 and feature game module 623 which probability table 641, 642 to employ when conducting the base game based on the player instruction. The base game and feature game modules use these probability tables to determine game outcomes from which prizes can be awarded.

Figure 7:
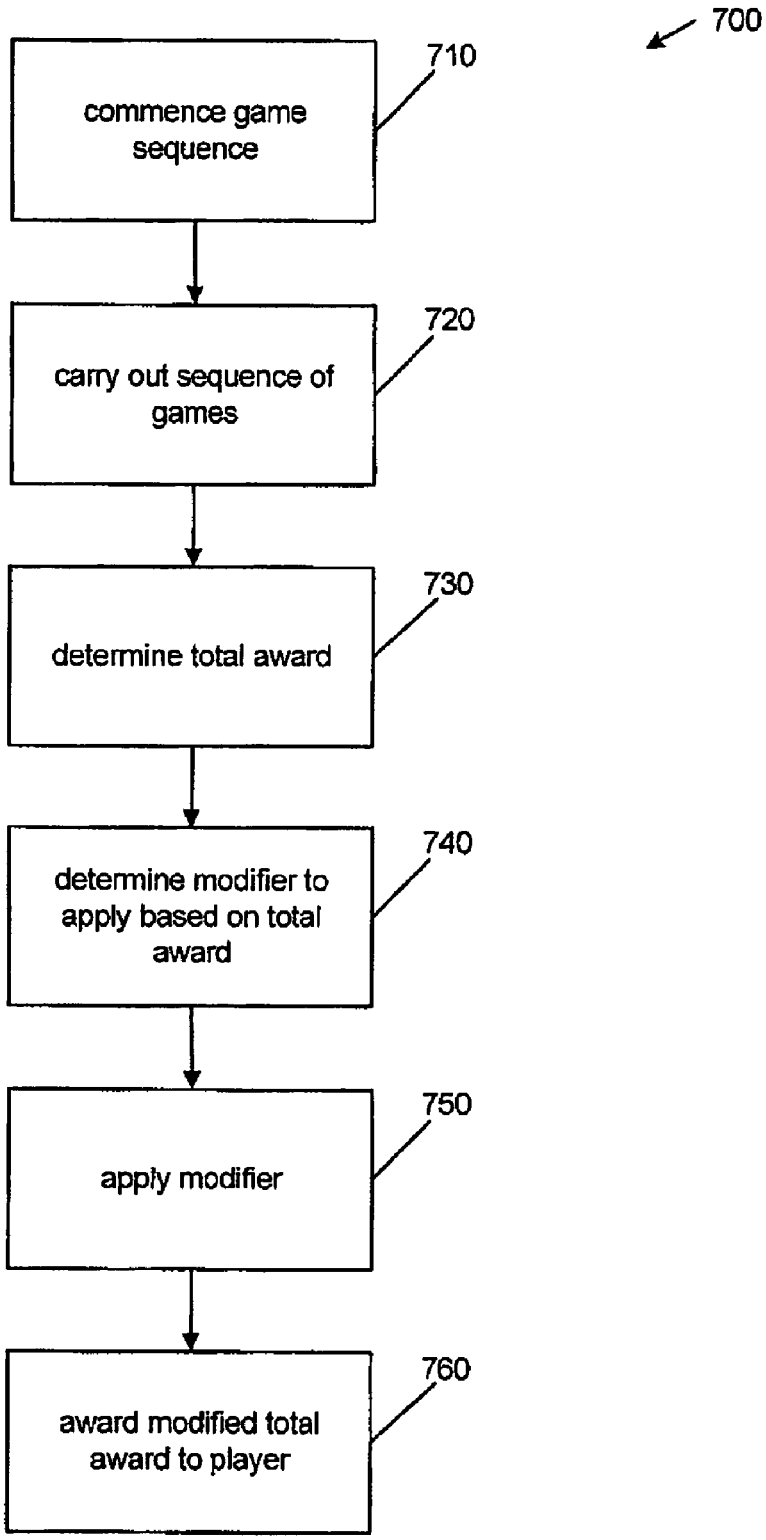
FIG. 7 is a flowchart of an embodiment.

The method 700 of the embodiment is summarized in FIG. 7 which shows an RTP instruction being received from the player 710 and the RTP being configured 720.

In the embodiment, the RTP controller 622 may be configured only to receive the RTP adjustment instructions when the gaming system is in certain states, for example, the RTP controller 622 will typically only allow the RTP to be adjusted during the base game so that a player cannot obtain the benefit of a relatively high RTP for the base game and then seek to obtain a high RTP from the feature game during the feature.

In other embodiments, other restrictions may be placed on when a player may alter the RTP. For example in some embodiments it may only be possible to make changes after a predetermined time period or at the start or beginning of a gaming session. Further, the capacity to change the RTP may be limited to certain types of players. For example, players using a player loyalty system card. Still further, the RTP controller may only be available when bets are over a certain amount or if an ante bet is made.

Figure 8A:
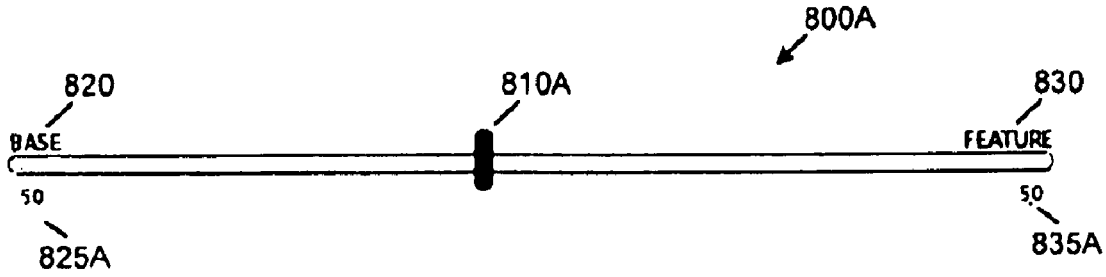
FIGS. 8*a* to 8*c* show an exemplary player interface.
Figure 8B:
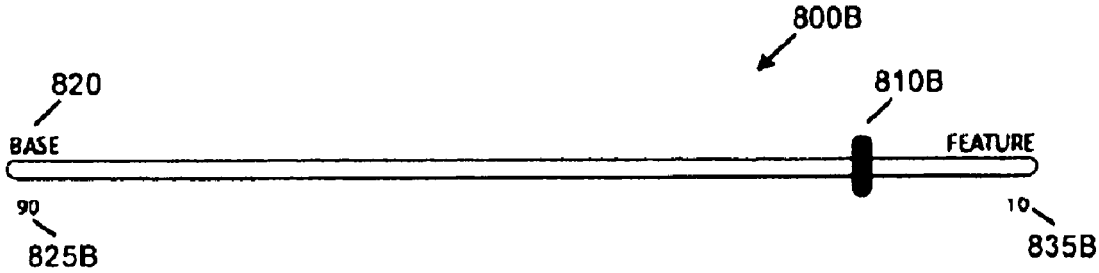

FIG. 8 illustrates an exemplary slider bar to be used by a player to adjust the relative contribution of the RTP. In the embodiment, the slider bar would be placed in the top right hand corner of the display of a game and only be active when the game is in idle status. By default, it typically starts at 50:50 as illustrated in FIG. 8A from which it will be seen that an initial configuration 800A the base game 820 has a contribution of 50% 825A and the feature game has a contribution of 50% 835A as indicated by placing the slider bar 810A in the middle of slider bar. The player may adjust the slider bar in accordance with techniques known in the art, including by pressing buttons to move the slider bar or operating a touch screen. As illustrated in FIG. 8B the player has moved the slider bar to the extreme right so that the slider bar 810B indicates the contribution of 90% by the base game 825B and 10% by the feature game 835B.

Figure 8C:
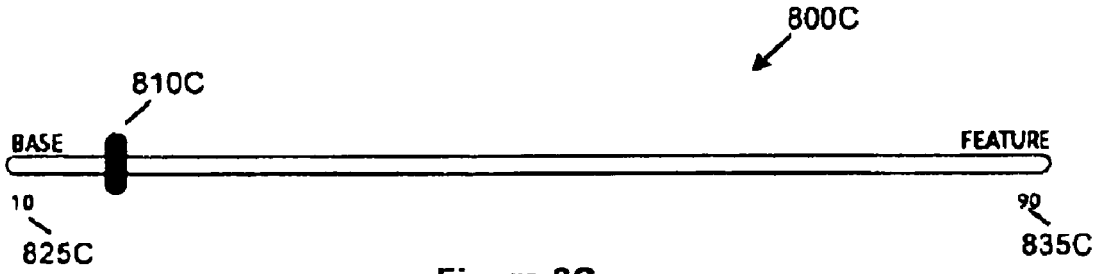

FIG. 8C illustrates a further configuration 800C where a player has allocated relative contribution of 10% to the base game and 825C and 90% to the feature game 835C as indicated by the position of slider bar 810C.

Persons skilled in the art will appreciate from the above, that limitations may be placed on the relative contributions of the game. That is in this game illustrated in FIG. 8, a player can only adjust the relative contribution within the range of 90 to 10. Persons skilled in the art will appreciate that the contribution can be represented in other ways, for example, the player may be advised that there is a volatility of 20% between the base and feature game and accordingly they can allocate this 20% in the range 0 to 100—i.e. as a proportion of the available 20%. Other variations will be apparent to persons skilled in the art.

Various other modifications will be apparent to persons skilled in the art. In particular, the features described above can be combined to form additional embodiments. In the claims which follow and in the preceding description of the invention, except where the context indicates otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. The present invention contemplates methods, systems and program products on any electronic device and/or machine-readable media suitable for accomplishing its operations. Certain embodiments of the present invention may be implemented using an existing computer processor and/or by a special purpose computer processor incorporated for this or another purpose or by a hardwired system, for example.

Embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

Method steps associated with certain embodiments may be implemented in one embodiment by a program product including machine-executable instructions, such as program code, for example in the form of program modules executed by machines in networked environments. Generally, program modules include routines, programs, objects, components, data structures, etc., that perform particular tasks or implement particular abstract data types. Machine-executable instructions, associated data structures, and program modules represent examples of program code for executing steps of the methods disclosed herein. The particular sequence of such executable instructions or associated data structures represents examples of corresponding acts for implementing the functions described in such steps.

The invention claimed is:

1. A gaming network comprising:

a game controller arranged to conduct a game having an overall return to player (RTP) and comprising a base game and a feature game, the game controller arranged to conduct a base game and a feature game, and comprising an RTP controller arranged to operate in response to a player RTP instruction to configure a relative contribution of the base game and the feature game to the overall RTP, wherein the contribution to the overall RTP by the base game is complementary to the contribution to the overall RTP by the feature game and wherein adjustment to the RTP is allowable in only one of the base game and the feature game such that the player cannot obtain the benefit of a relatively high RTP in both the base game and the feature game.

2. A game controller as claimed in claim 1, comprising:

a base game module arranged to conduct a base game having a base RTP; and a feature game module is arranged to conduct a feature game having a feature RTP.

3. A game controller has claimed in claim 2, wherein the RTP controller configures the relative contribution of the base RTP and the feature RTP by specifying base RTP data and feature RTP data to be employed by the base game module and feature game module respectively.

4. A game controller as claimed in claim 2, wherein the RTP of the base game has an allowable range.

5. A game controller as claimed in claim 2, wherein the RTP of the feature game has an allowable range.

6. A game controller as claimed in claim 1, wherein the player RTP instruction includes data specifying a value within a range of allowable relative RTPs of the base game and feature game.

7. A game controller as claimed in claim 1, constituted by a processor arranged to execute instructions stored in a memory to implement at least the RTP controller.

8. A gaming system comprising:

a player interface comprising an RTP instruction mechanism operable by a player to input an RTP instruction; and an RTP controller arranged to configure a relative contribution of the base game and a feature game to the overall RTP of the game in response to the RTP instruction, wherein the contribution to the overall RTP by the base game is complementary to the contribution to the overall RTP by the feature game and wherein adjustment to the RTP is allowable in only one of the base game and the feature game such that the player cannot obtain the benefit of a relatively high RTP in both the base game and the feature game.

9. A gaming system as claimed in claim 8, wherein the RTP instruction mechanism is operable to select a plurality of relative RTPs within a range.

10. A gaming system as claimed in claim 9, wherein the player interface comprises a display and RTP instruction mechanism comprises a slider bar displayed on the display and operable by a player to select a position within the range.

11. A gaming system as claimed in claim 10, wherein the player interface comprises a touch screen operable to select the position of the slider bar.

12. A gaming system as claimed in claim 11 wherein the touch screen is operable by a player to drag the slider bar.

13. A method of gaming comprising:

providing a game having an overall RTP, the game comprising a base game and a feature game; and configuring a relative contribution of the base game and the feature game to the overall RTP in response to a players instruction, wherein the contribution to the overall RTP by the base game is complementary to the contribution to the overall RTP by the feature game and wherein adjustment to the RTP is allowable in only one of the base game and the feature game such that the player cannot obtain the benefit of a relatively high RTP in both the base game and the feature game.

14. A method as claimed in claim 13, comprising configuring the relative contribution of the base RTP and the feature RTP by specifying base RTP data and feature RTP data to be employed by a base game module and a feature game module respectively.

15. A method as claimed in claim 14, comprising controlling the RTP of the base game to be within an allowable range.

16. A method as claimed in claim 14, comprising controlling the RTP of the base game to be within an allowable range.

17. A player interface for a game comprising a base game and a feature game, the player interface comprising an RTP instruction mechanism operable by a player to input a player instruction specifying a relative contribution to an overall RTP of at least one of the base game or the feature game, wherein the contribution to the overall RTP by the base game is complementary to the contribution to the overall RTP by the feature game and wherein adjustment to the RTP is allowable in only one of the base game and the feature game such that the player cannot obtain the benefit of a relatively high RTP in both the base game and the feature game.

18. A player interface as claimed in claim 17, wherein the player interface comprises a display and RTP instruction mechanism comprises a slider bar displayed on the display and operable by a player to select a position within the range.

19. A player interface as claimed in claim 18, wherein the player interface comprises a touch screen operable to select the position of the slider bar.

20. A player interface as claimed in claim 19 wherein the touch screen is operable by a player to drag the slider bar.

21. A tangible computer readable storage medium comprising computer program code which when executed implements a method of gaming comprising:

providing a game having an overall RTP, the game comprising a base game and a feature game; and configuring a relative contribution of the base game and the feature game to the overall RTP in response to a players instruction, wherein the contribution to the overall RTP by the base game is complementary to the contribution to the overall RTP by the feature game and wherein adjustment to the RTP is allowable in only one of the base game and the feature game such that the player cannot obtain the benefit of a relatively high RTP in both the base game and the feature game.

* * * * *